US009770073B2

(12) United States Patent
Ryou

(10) Patent No.: US 9,770,073 B2
(45) Date of Patent: Sep. 26, 2017

(54) BUCKLE

(71) Applicant: Yang-Seog Ryou, Suwon Gyeonggi-do (KR)

(72) Inventor: Yang-Seog Ryou, Suwon Gyeonggi-do (KR)

( * ) Notice: Subject to any disclaimer, the term of this patent is extended or adjusted under 35 U.S.C. 154(b) by 336 days.

(21) Appl. No.: 14/429,809

(22) PCT Filed: Dec. 4, 2013

(86) PCT No.: PCT/KR2013/011153
§ 371 (c)(1),
(2) Date: Mar. 20, 2015

(87) PCT Pub. No.: WO2014/129731
PCT Pub. Date: Aug. 28, 2014

(65) Prior Publication Data

US 2015/0223571 A1 Aug. 13, 2015

(30) Foreign Application Priority Data

Feb. 21, 2013 (KR) ..... 10-2013-0018368

(51) Int. Cl.
*A44B 11/00* (2006.01)
*A44B 11/06* (2006.01)
(Continued)

(52) U.S. Cl.
CPC ..... *A44B 11/16* (2013.01); *A41F 1/008* (2013.01); *A44B 11/20* (2013.01); *Y10T 24/4072* (2015.01)

(58) Field of Classification Search
CPC . Y10T 24/4016; Y10T 24/4072; A44B 11/16; A44B 11/20; A41F 1/008
See application file for complete search history.

(56) References Cited

U.S. PATENT DOCUMENTS 1,278,340 A * 9/1918 Hayden et al. ..... A44B 11/00 24/170
1,364,613 A * 1/1921 Cochrane ..... A44B 11/06 24/163 R
(Continued)

FOREIGN PATENT DOCUMENTS

JP 2000-303233 A 10/2000
JP 2004-135724 A 5/2004
(Continued)

OTHER PUBLICATIONS

International Search Report for PCT/KR2013/011153 dated Feb. 18, 2014 from Korean Intellectual Property Office.
(Continued)

*Primary Examiner* — Robert J Sandy
*Assistant Examiner* — Jason W San
(74) *Attorney, Agent, or Firm* — Paratus Law Group, PLLC

(57) ABSTRACT

A buckle for tightening or loosening a band, including: a buckle body having a pair of hinge holes; a plate spring arranged in the buckle body with a leading part positioned in a sliding path of the band, the leading part being shaped to slope with a leading end contacting a back side of the band so as to be caught by a catch projection of the band; and a buckle switch having a pivot pressure piece with hinge projections, and an operation lever connected to a pivot pressure piece so as to be exposed to one side of the buckle body. The leading end of the plate spring is separated from the band so as to make the band slide in a loosening direction when the plate spring is pressed by the pivot pressure piece.

8 Claims, 16 Drawing Sheets

(51) Int. Cl.

| | |
|---|---|
| ***A44B 11/25*** | (2006.01) |
| ***A44B 11/16*** | (2006.01) |
| ***A41F 1/00*** | (2006.01) |
| ***A44B 11/20*** | (2006.01) |

(56) References Cited

U.S. PATENT DOCUMENTS

| | | | | | |
|---|---|---|---|---|---|
| 1,483,853 | A * | 2/1924 | Schwerd | A44B 11/00 | 24/163 R |
| 2,069,559 | A * | 2/1937 | Ritter | A44C 5/24 | 24/71 J |
| 3,049,776 | A * | 8/1962 | Pugniet | A41F 11/12 | 24/170 |
| 3,872,554 | A * | 3/1975 | Wolfertz | A41F 1/008 | 24/1 |
| 3,950,827 | A * | 4/1976 | Kanzaka | A41F 1/008 | 24/590.1 |
| 3,956,802 | A * | 5/1976 | Kanzaka | A41F 1/008 | 2/237 |
| 4,578,827 | A * | 4/1986 | Appelt | A41F 1/008 | 2/221 |
| 4,640,281 | A * | 2/1987 | Sturm | A44B 11/25 | 24/115 G |
| 4,727,630 | A | 3/1988 | Alan | | |
| 4,733,440 | A * | 3/1988 | Ogawa | A44B 11/06 | 24/170 |
| 4,823,443 | A * | 4/1989 | Waters | A44B 11/125 | 24/68 CD |
| 4,916,779 | A * | 4/1990 | Terada | A41F 1/008 | 24/171 |
| 5,144,724 | A * | 9/1992 | Chuan | A44B 11/06 | 24/197 |
| 5,161,351 | A * | 11/1992 | Woodruff | A44B 11/14 | 24/170 |
| 5,181,300 | A * | 1/1993 | Schwarz | A41F 1/008 | 24/170 |
| 5,291,638 | A * | 3/1994 | Huang | A44B 11/14 | 24/170 |
| 5,404,623 | A * | 4/1995 | Smiedt | A41F 1/008 | 24/194 |
| 5,572,747 | A * | 11/1996 | Cheng | A44B 11/12 | 2/312 |
| 5,579,563 | A * | 12/1996 | Sim | A41F 9/002 | 24/170 |
| 5,588,186 | A * | 12/1996 | Ko | A44B 11/14 | 24/170 |
| 5,774,947 | A * | 7/1998 | Anscher | A44B 11/06 | 24/171 |
| 5,774,952 | A * | 7/1998 | Ito | A41F 1/008 | 24/578.15 |
| 6,081,973 | A * | 7/2000 | Liu | A44B 11/24 | 24/170 |
| 6,148,485 | A * | 11/2000 | Wu | A44B 11/14 | 24/163 R |
| 6,427,291 | B1 * | 8/2002 | Kim | A44B 11/14 | 24/163 R |
| 6,868,585 | B2 * | 3/2005 | Anthony | A44B 11/14 | 24/134 R |
| 6,877,189 | B2 * | 4/2005 | Simonson | B60P 7/083 | 24/163 R |
| 7,631,401 | B2 * | 12/2009 | Chen | A44B 11/02 | 24/171 |
| 8,561,267 | B2 * | 10/2013 | Chang | A44B 11/12 | 211/89.01 |
| 8,667,651 | B2 * | 3/2014 | Wang | A44B 11/005 | 24/170 |
| 8,689,364 | B2 * | 4/2014 | Rowland | A41F 9/025 | 2/311 |
| 8,869,354 | B2 * | 10/2014 | Horimoto | A42B 3/08 | 24/69 ST |
| 8,959,670 | B2 * | 2/2015 | Chiang | A63B 33/002 | 2/440 |
| 9,149,090 | B1 * | 10/2015 | Taylor | A41F 9/02 | |
| 9,591,895 | B2 * | 3/2017 | Shirai | A44B 11/223 | |
| 2009/0094809 | A1 * | 4/2009 | Kung | A44B 11/25 | 24/625 |
| 2016/0051014 | A1 * | 2/2016 | Resnick | A44B 11/16 | 368/232 |
| 2016/0198783 | A1 * | 7/2016 | Ryou | A41F 1/008 | 24/482 |

FOREIGN PATENT DOCUMENTS

| | | | |
|---|---|---|---|
| KR | 20-1998-0062310 | U | 11/1998 |
| KR | 20-0376460 | Y1 | 3/2005 |
| KR | 10-2010-0111024 | A | 10/2010 |
| KR | 10-1178766 | B1 | 8/2012 |

OTHER PUBLICATIONS

May 20, 2013, Korean Notice of Allowance for related KR application No. 10-2013-0018368.

Jun. 13, 2017, Chinese Office Action for related CN application No. 201380029096.8.

* cited by examiner

BUCKLE

CROSS REFERENCE TO PRIOR APPLICATION

This application is a National Stage Patent Application of PCT International Patent Application No. PCT/KR2013/011153 (filed on Dec. 4, 2013) under 35 U.S.C. §371, which claims priority to Korean Patent Application No. 10-2013-0018368 (filed on Feb. 21, 2013) which are all hereby incorporated by reference in their entirety.

TECHNICAL FIELD

The present invention relates to a buckle, and more particularly, to a simply structured buckle that reduces the production cost, makes the fastening state firm and reliable, and gives an aesthetic appearance.

BACKGROUND ART

Generally, a belt is composed of a band and a buckle, and a buckle binds two ends of a band or is placed at a waist of pants or a skirt so as to adjust the waist measurement of the pants or the skirt according to the wearer. The buckle easily slides in a direction that the band is fastened, i.e., in a forward direction, but the buckle does not slide in a direction that the band is loosed, i.e., in a backward direction, and thereby the band's fastened state is maintained. Hence, the buckle includes components for controlling the slide of the band. FIG. 1 shows one of the conventional buckles. As illustrated, the buckle includes a buckle body 12 for slidingly passing a band 4 which is arranged widthwise, and a slide controller which is mounted on the buckle body 12. The controller includes a stopper housing 13 which is mounted on the back side of the buckle body 12 as a hinge axis 11, a stopper 14 which is inserted into the stopper housing 13 in a manner that the end part may be rotated, an operation handle 15 which is projected outside the stopper housing 13, and a spring 16 which is placed in the stopper housing and gives elastic pressure to the stopper 15 so that the leading part of the stopper 15 may be pressured on the back side of the band.

In the buckle having such a configuration, if the band 4 is pulled in the forward direction, the spring 16 is pressured by the pulled force of the band 4 so that the band 3 slides in the forward direction. However, if the band 4 is pulled in the backward direction, the catch projection 2 of the band 4 is caught on the leading part of the stopper 14 so that the band 4 does not slide. Further, in order to loose the band 4, the operation handle 15 is rotated so that the leading part of the stopper 15 may be separated from the band 4, and the band 4 is pulled in the backward direction.

However, such a buckle includes the buckle body, 12, the stopper housing 13, the stopper 14, the operation handle 15, and the spring, and thus the number of parts of the buckle is large. Further, the stopper 14 and the spring 16 need to be mounted on the stopper housing 13 and the stoppering housing 13 needs to be mounted on the buckle body 12, and thus the assembly process is complicated. Further, the end of the stopper 14 and the spring 16 are inserted into the stopping housing 13, thus the stopper housing 13 becomes relatively thick, thus the overall thickness of the buckle becomes large, which makes the buckle unshapely. Further, when the buckle is thick, if the wearer of the buckle lies down, the wear would feel uncomfortable.

DISCLOSURE

Technical Problem

An object of the present invention is to provide a simply structured buckle that is composed of a small number of parts, is simply assembled, reduces the production cost, makes the fastening state firm and reliable, and gives an aesthetic appearance.

Technical Solution

The present invention provides a buckle for tightening or loosening a band 4 with the back side having catch projections formed widthwise, the buckle including: a buckle body 100 having an insertion hole 102 and an exit hole 104 for slidingly passing the band 4, and a pair of hinge holes 123 formed across the sliding path of the band 4; a plate spring 200 arranged in the buckle body 100 with the leading part positioned in the sliding path of the band 4, the leading part being shaped to slope with the leading end contacting the back side of the band 4 so as to be caught by the catch projection 2 of the band 4 when pulling or pushing the band 4 toward the direction of loosening it and thus to control the slide of the band 4; and a buckle switch 300 having a pivot pressure piece 310 with hinge projections 312, 314 at both ends inserted in the hinge holes 123 so as to be hinged to the buckle body 100 and positioned between the band 4 and the plate spring 200, and an operation lever 320 connected to the pivot pressure piece 310 so as to be exposed to one side of the buckle body 100, wherein, when the plate spring 200 is pressed by the pivot pressure piece 310, the leading end of the plate spring 200 is separated from the band 4 so as to make the band 4 slide in the loosening direction.

The pivot pressure piece 310 may be tilted in the same direction as the tilted direction of the plate spring, the leading part may be positioned on the sliding path of the band 4, and thus if the band 4 is pulled or pushed in a loosed direction, the leading part of the pivot pressure piece 310 along with the leading part of the plate spring 200 may be caught on the catch projection 2 of the band 4 so that the slide of the band 4 is controlled.

The plate spring 200 may be mounted on the buckle body 100 as a separate part or may be integrally formed with the buckle body 100.

The plate spring 200 may cut a part of the buckle body 100 and may be folded into the buckle body 100.

The leading part of the plate spring 200 may include: a first slope part 222 which is caught on a catch projection 2 as the first slope part gets tilted toward the end to be close to the band 4; a second slope part 224 which is extended from the end of the first slope part so have a gradient lower than the gradient of the first slope part; and a third slope part 226 which is extended from the end of the second slope part to have a gradient larger than the gradient of the second slope part, wherein a projection 228 is formed between the second slope part and the third slope part and the projection 228 is pressured by rotation of the pivot pressure piece 310.

In the plate spring 200, a concave part 229, which is concave in a direction opposite to the tilted direction of the leading part of the plate spring 200, may be formed at the end of the third slope part 226, and the pivot pressure piece may be hinge-jointed to the buckle body 100 to be positioned at the concave part 229.

The buckle body 100 may be formed by bending the metal plate, an opening 126 may be formed on the buckle body 100 by a cut piece 128 which is cut in a form that divides the hinge hole 123, and, if the pivot pressure piece 210 is inserted into the buckle body 100 through the opening 126 and then the opening 126 is closed with the cut piece 128, the pivot pressure piece 310 may be hinge-jointed to the hinge hole 123.

The buckle body 100 may be injection-molded, an opening for inserting the pivot pressure piece into the buckle body 100 may be extended and a pair of V-shaped projections facing each other may be formed between the hinge hole 123 and the opening 125, a notch 315 corresponding to the V-shaped projections 129 may be formed at the end of the pivot pressure piece, if the pivot pressure piece 310 is inserted into the buckle body 100 by arranging the V-shaped projections 129 and the notch 315, the pivot pressure piece 310 may be elastically supported by the plate spring 200 and is rotated with a slope, and hinge projections 312 and 314 may be moved from the hinge hole 123 to the opening 125 by the V-shaped projections 129.

Advantageous Effects

The present invention has a simple configuration including a buckle body 100, a plate spring 200, and a button switch 300, and thus the number of parts is small and an assembly is easy.

Further, when the buckle body 100 is formed by ending a metal plate and the plate spring 200 is integrally formed with the buckle body 100, the process of assembling the plate spring 200 with the buckle body 100 is omitted, and thus the manufacturing process is reduced. In particular, when the plate spring 200 cuts the back side part 100 of the buckle body 100 and is bent, the needed materials are reduced, thereby reducing costs.

In the present invention, the plate spring 200 functions as a stopper which controls the sliding of the band 4 in a direction that the band 4 is loosed, i.e., in the backward direction. In particular, if the band 4 is pulled or pushed in the backward direction, the tilted leading part of the plate spring 200 is raised up by the catch projection 2 of the band 4, and thus the plate spring 200 is further pressured in the band 4, and thus even if strong force is applied to the band 4, the buckle is not loosed. Hence, the present invention provides a buckle having a superior fastening performance.

Further, if the projection 228 is formed in the plate spring and the pivot pressure piece 310 is configured to pressure the projection 128, strong force is applied to the plate spring 200 even if the user slightly rotates the operation lever 320 with little force, and thus any one can easily use it. Further, because the user can easily loose the buckle by compressing the plate spring 200 with a little force, the user does not feel inconvenient even if a plate spring having relative high intensity is used, and thus it is possible to provide a product whose fastening performance is superior and which is convenient.

Further, when the pivot pressure piece 310 of the buckle switch 300 along with the plate spring 200 is configured to function as a stopper, the force of controlling the band 4 when pulling the band 4 is distributed into two parts which contact the plate spring 200 and the pivot pressure piece 310, and thus the damage of the band 4 is prevented, and the fastening performance of the buckle is enhanced. Hence, the loosening of the band is certainly prevented, and thus it is possible to enhance reliability of the products.

Further, in the present invention, the plate spring 200 functions as a stopper which controls the sliding of the band, and thus a space for a separate stopper as in the existing buckle is not required. Further, the pivot pressure piece 310 and the plate spring 200 are configured and mounted to occupy relative less space, and thus the buckle becomes slim and aesthetic.

The buckle body 100, which may directly contact the skin of the wearer, may be formed with synthetic resins. If the buckle boy 100 is formed with the synthetic resins, the wearer may feel comfortable, the shapes and colors of the buckle body 100 may be more diversified, and the logos or marks of the manufacturer may be more easily carved.

Further, the pivot pressure piece 310 may be configured to function as a stopper which controls the sliding of the band 4 in the backward direction. At this time, the plate spring 20 elastically supports the leading part of the pivot pressure piece 310 so that the leading part may be positioned slant on the sliding path of the band 4.

DESCRIPTION OF REFERENCE NUMERALS

Figure 1:
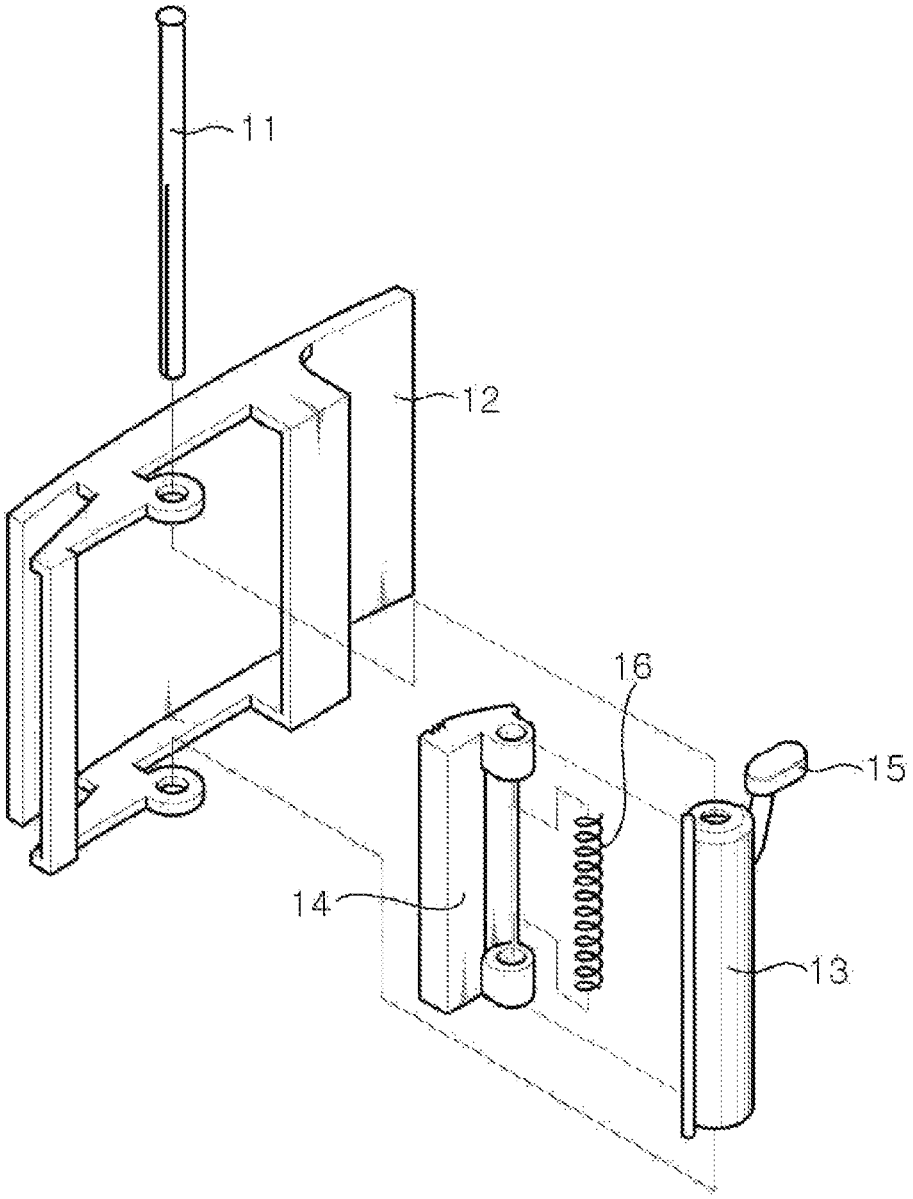
FIGS. 1 and 2 an exploded perspective view and a perspective view of a buckle according to a conventional art.
Figure 2:
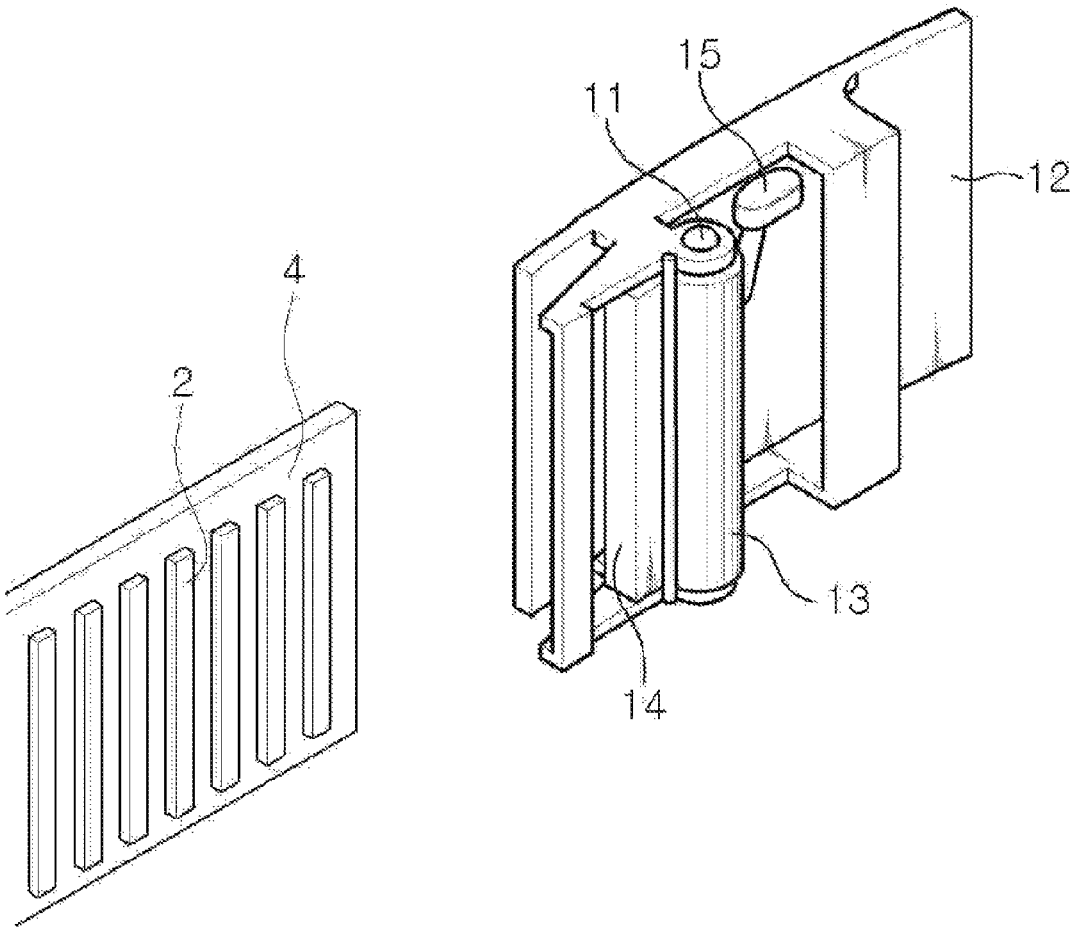

1. adherend
2. catch projection
4. band
100. buckle body
102. insertion hole
104. exit hole
110. back side part
110*a*. back side forming unit
114*a*. extension part
116. plate spring mounting groove
120. upper surface part
120*a*. upper surface forming unit
121. lower surface part
121*a*. lower surface forming unit
123. hinge hole
124. cutting line
125. opening
126. opening
128. cut piece

129. V-shaped projection
130. front surface part
130*a*, 131*a*. front surface forming unit
140. connection part
140*a*. connection forming unit
141. hole
200. plate spring
200-1. plate spring
222. first slope part
224. second slope part
226. third slope part
228. projection
229. concave part
300. buckle switch
310. pivot pressure piece
312, 314. hinge projection
315. notch
320. operation lever

BEST MODE

Hereinafter, embodiments of the present invention will be described with reference to the attached drawings.

Figure 3A:
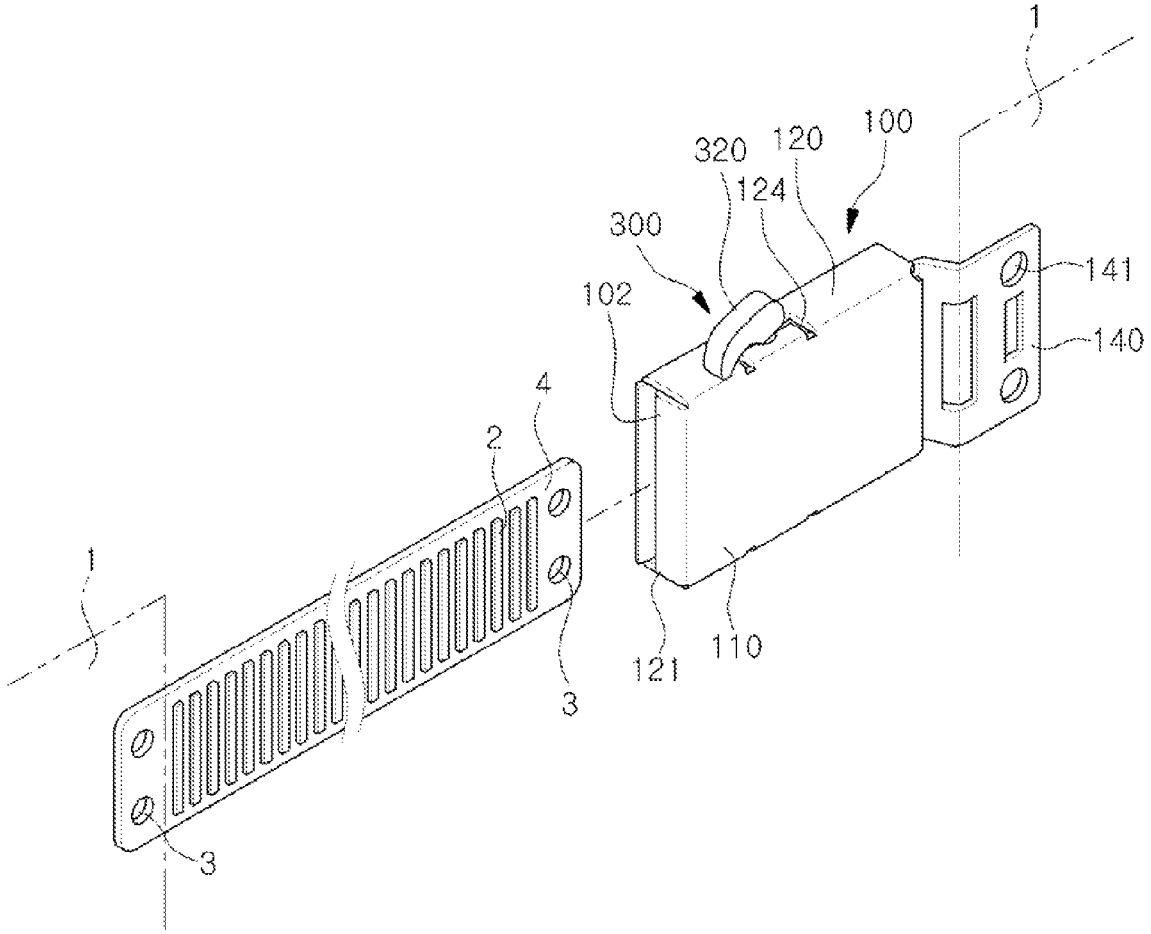
FIGS. 3A and 3B a rear perspective view and a front perspective view schematically illustrating a buckle according to a first embodiment of the present invention.
Figure 3B:
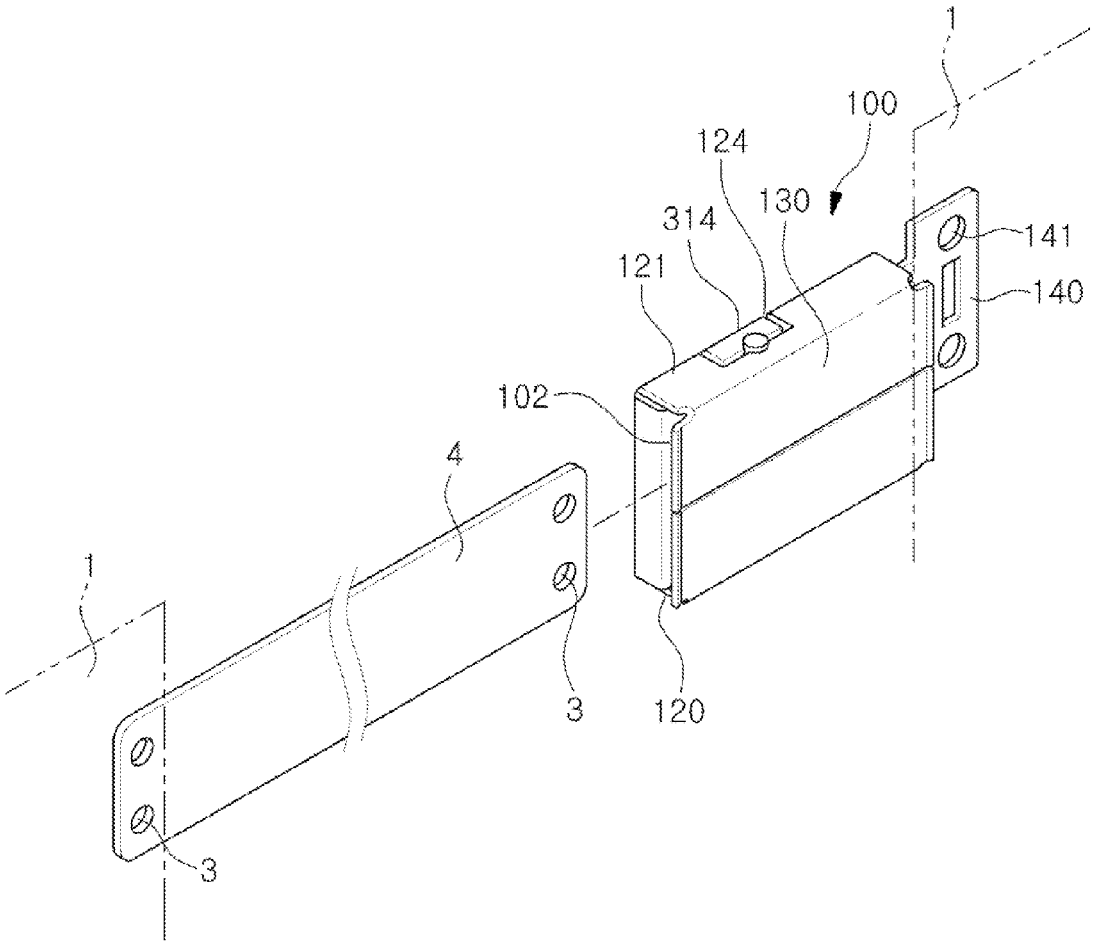
Figure 4:
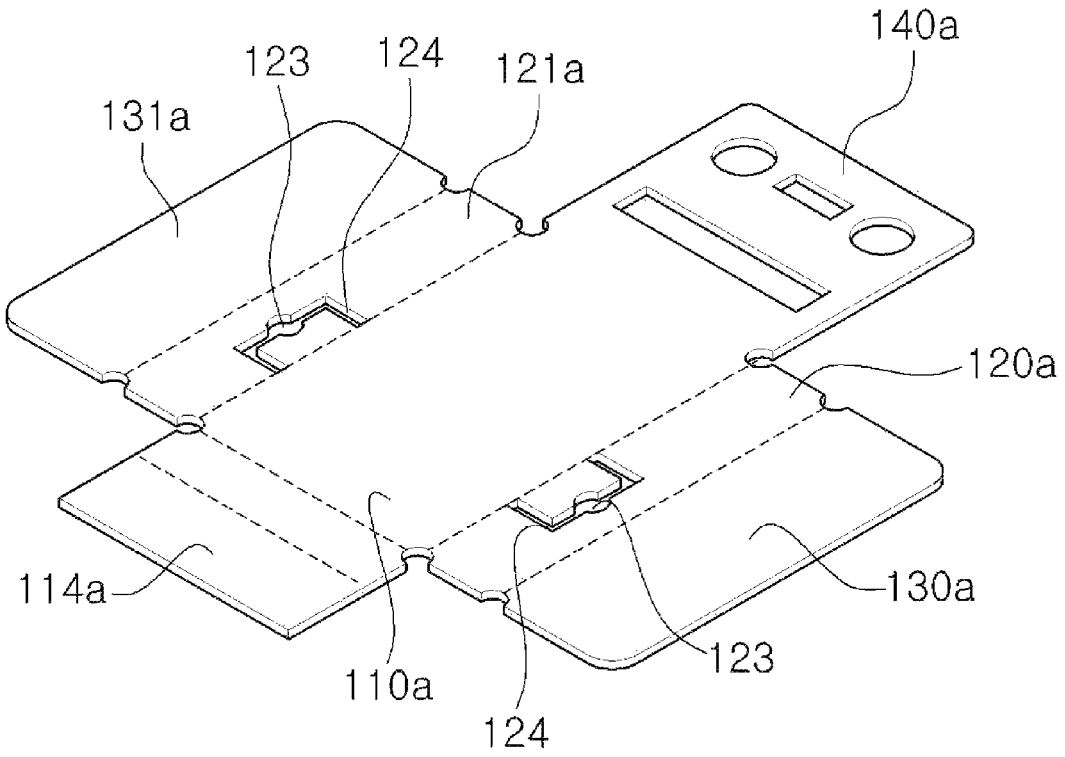
FIG. 4 is a perspective view of a metal place for assembling a buckle body according to a first embodiment of the present invention.

FIGS. 3A and 3B a rear perspective view and a front perspective view schematically illustrating a buckle according to a first embodiment of the present invention, FIG. 4 is a perspective view of a metal place for assembling a buckle body according to a first embodiment of the present invention, and FIG. is an exploded perspective view schematically illustrating a buckle according to a first embodiment of the present invention.

Referring to FIGS. 3A to 5, the present invention provides a buckle for tightening or loosening a band 4 with the back side having catch projections 2 formed widthwise, including a buckle body 100, a plate spring 200 arranged in the buckle body 100 with the leading part positioned in the sliding path of the band 4, and a buckle switch 300 having a pivot pressure piece 310 with hinge projections 312, 314 at both ends inserted in the hinge holes 123.

The buckle body 100 includes a back side part 110, upper and lower surface parts 120 and 121, a front surface part 130 which is extended to the upper and lower surface parts 120 and 121 and is facing the back side part 110, and a connection part for connecting the buckle body 100 to an adherend 1 such as clothes or a cap.

An insertion hole 102 and an exit hole 104 for passing the band 4 are formed at both right and left sides of the buckle body 100.

The band 4 is attached on the adherend 1 through a hole formed on the end part. Preferably, the band is easily attached on the adherend by forming the band 4 to be horizontally symmetrical as the hole 3 is formed on both ends of the band 4.

The buckle body 100 is formed by bending the metal plate.

Referring to FIG. 4, the buckle body 100 includes a back side forming unit 110*a* which forms a back side part 110, upper and lower surface forming units 120*a* and 121*a* which are extended from the side facing the back side forming unit 110*a* and form the upper and lower surface parts 120 and 121, and front surface forming units 130*a* and 131*a* which are extended from the upper and lower surface forming units 120*a* and 121*a* in order to form the front surface part 130, a connection forming unit 140*a* which is extended to form the connection part 140 at one of the remaining sides of the back side forming unit 110*a*, and an extension part 114*a* for forming a plate spring mounting groove 116 at the other of the remaining sides of the back side forming unit 110*a*.

The side where the plate spring mounting groove 116 is formed forms an insertion hole 103 into which the band 4 is inserted.

Further, the upper and lower surface parts 120 and 121 include a configuration for assembling a buckle switch 300. A hinge hole 123 for mounting the buckle switch 300 and U-shaped cutting line 124 for dividing the hinge hole 123 is formed.

Figure 5:
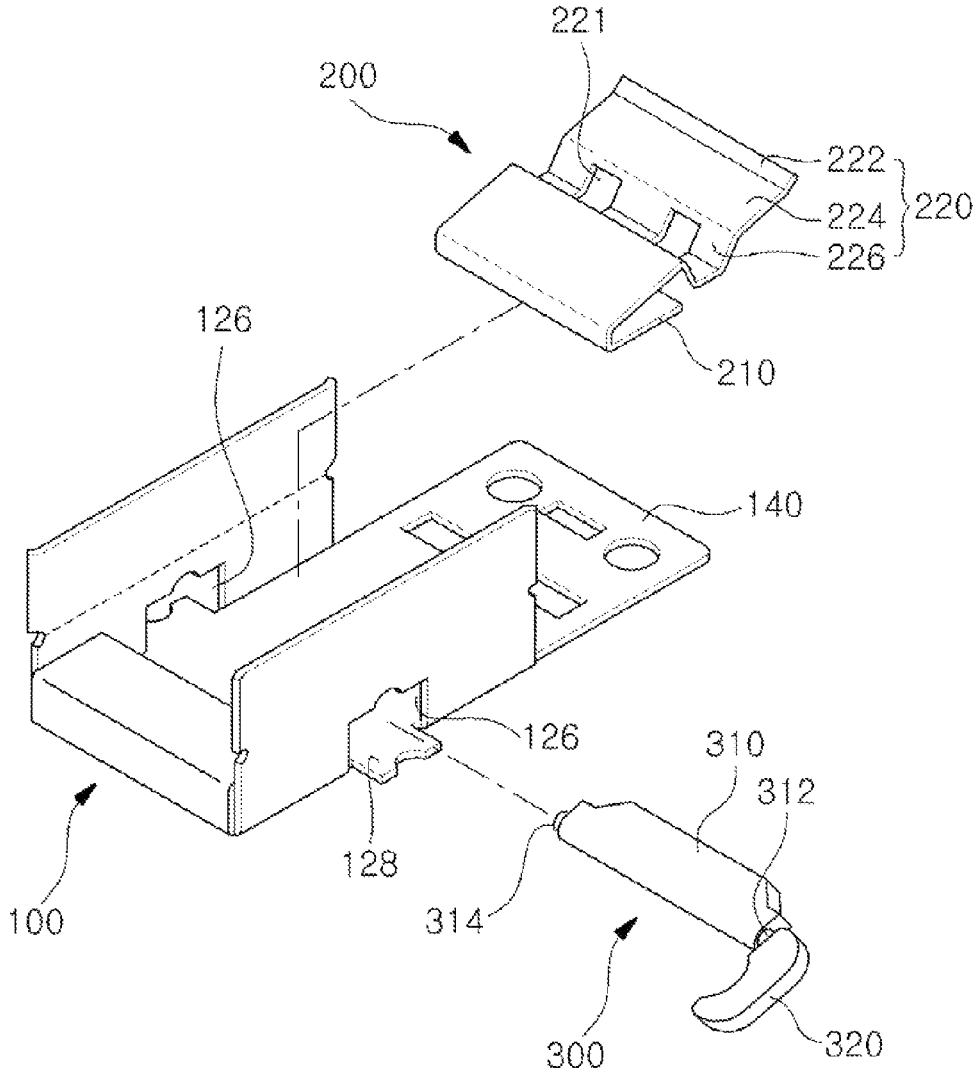
FIG. 5 is an exploded perspective view schematically illustrating a buckle according to a first embodiment of the present invention.

As illustrated in FIG. 5, the plate spring 200 is mounted on the buckle body 100 as a separate part.

The plate spring 200 includes a base part 210 which is placed on the back side part 110 of the buckle body 100 and an elastic part 220 which is bent at the base part 210 and has elasticity. The connection part of the base part 210 and the elastic part 220 is inserted into the plate spring mounting groove 116 of the buckle body 100 so as to be mounted on the buckle body 100.

The elastic part 220 of the plate spring 200 has a tilted shape toward the leading part to get close to the front part 130 of the buckle body 100, i.e., the sliding pth of the band 4.

Preferably, the leading part of the elastic part 220 includes a first slope part 222 which is tilted to get close to the band 4 toward the end, a second slope part 224 which is extended from the end of the first slope part so have a gradient lower than the gradient of the first slope part, and a third slope part 226 which is extended from the end of the second slope part to have a gradient larger than the gradient of the second slope part. Hence, a projection 228 is formed between the second slope part and the third slope part. Further, in the plate spring 200, a concave part 229, which is concave in a direction opposite to the tilted direction of the leading part of the plate spring 200, is formed at the end of the third slope part 226.

The concave part 229 is used to reduce the thickness of the buckle, which will be described later.

A groove 221 is formed at the plate spring 200 in order to enhance the elasticity.

Further, the buckle switch 300 includes a pivot pressure piece, where hinge projections 312 and 314 are formed at both upper and lower end parts, and an operation lever 320, which is projected from one side hinge projection of the pivot pressure piece 310. Preferably, the operation lever 320 is not formed in a straight line form with the pivot pressure piece 310, but it is formed in a form that is bent at a certain angle. As such, even if the operation lever 320 is relatively long, it is not projected much to the outside of the buckle body 100.

The buckle switch 300 is positioned between the front part 130 of the buckle body 100 and the plate spring 200 and is hinge-jointed with the buckle body 100 in the vertical direction of the buckle body 100, i.e., a direction parallel to the sliding path of the band 3. At this time, the operation lever 320 is projected to the outside of the buckle body 100.

Preferably, the hinge hole 123, which is hinge-jointed with the pivot pressure piece 310, is formed to be arranged with the concave part 229 formed at the plate spring 200. As such, the end part of the pivot pressure piece 310, i.e., the rotation center part is inserted into the concave part 229 of the plate spring 200, and the leading part 310 has a position corresponding to the projection 228 of the plate spring 200.

As such, the pivot pressure piece 310 and the plate spring 200 are densely attached on the buckle body 100, and thus the buckle body 100 may be formed in a slimmer form.

Further, the leading part of the pivot pressure piece positioned in a manner that corresponds to the projection 228 of the plate spring, and thus if the pivot pressure piece 310 is rotated, the projection 228 is pressured. As such, strong force is applied to the plate spring 200 even if the user slightly rotates the operation lever with little force, and thereby the plate spring 200 is compressed.

Hereinafter, the assembly process of the present invention having such a configuration will be described with reference to FIGS. 4 and 5.

As illustrated in FIG. 4, a plate spring mounting groove 116, in which the plate spring 200 is mounted, is formed by bending the extension unit 114*a* which is extended from the left side of the back side forming unit 110*a* which forms the back side part 110 of the buckle body 100, and the connection part 140 is formed by bending the connection forming unit 140*a* which is formed at the right side of the back side forming unit 110*a*. Holes 141 for connecting the connection part 140 at the adherend or the other side of the band are made at the connection formation unit 140*a*.

Further, the upper and lower surface forming units 120*a* and 121*a* are bent. If the upper and lower surface forming units 120*a* and 121*a* are bent, the cut piece 128, which is cut by the cutting line 124, maintains the unfolded state. As such, an opening 126 of a shape corresponding to the cut piece 128 is formed at the bend upper and lower surface parts 120 and 121.

Further, the already molded plate spring 200 is inserted into the plate spring mounting groove 116 so as to be attached on the buckle body 100, and the front surface part 130 is formed by bending the front surface forming units 130*a* and 131*a*.

Further, as illustrated, the base part 210 of the plate spring 200 is formed only up to one end of the concave groove 229, and thus the space occupied by the plate spring 200 and the buckle body 100 become slim.

Thereafter, the buckle switch 300 is inserted into the buckle body 100 through the opening 126 which is formed on the buckle body 100, and the cut piece 128 is bent so as to close the opening 126.

As such, the hinge projections 312 and 314 of the buckle switch 300 are inserted into the hinge hole 123 so that the buckle switch 300 is assembled in the buckle body 100 in a rotatable manner.

Further, the opening 126 is formed at both the upper and lower surface parts 120 and 121 of the buckle body 100, and thus the buckle switch 300 may be selectively assembled at both sides of the buckle body 100 depending on the working environment, which is convenient.

Hereinafter, the operation after the assembly of the present invention will be described with reference to FIGS. 6A and 6B. Here, the direction in which the band 4 is fasten is called a forward direction, and the direction in which the band 4 is loosed is called a backward direction.

Figure 6A:
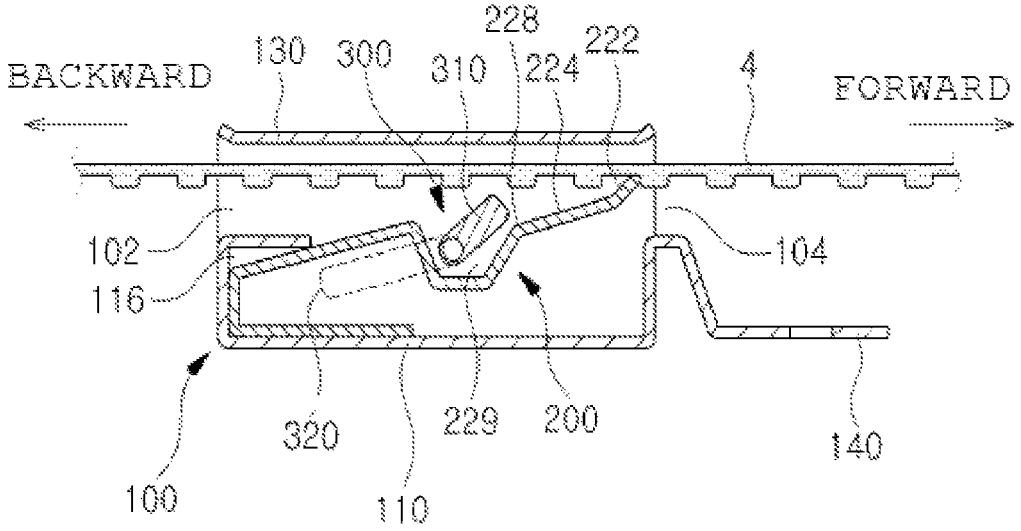
FIGS. 6A and 6B are a cross-sectional view illustrating an operation state according to a first embodiment of the present invention.

When intending to fasten the band 4, as illustrated in FIG. 6A, if the band 4 is pulled in a forward direction, i.e., to the exit hole 104 of the buckle body 100, the plate spring 200 is pressured by the force of pulling the band 4, and thereby the band 3 is freely slid.

In a reverse manner, if the band 4 is pulled in a backward direction, i.e., the band 4 is pushed from the exit hole 103 to the insertion hole 102 or is pulled from the insertion hole 103 in order to loose the band 4, the catch projection 2 of the band 4 is caught on the front part of the plate spring 200, i.e., the first slope part 222 so that the band 3 is slid. That is, it plays a role of a stopper function which controls the plate spring 200 not to be slid in a direction that the band 4 is loosed.

In particular, as the band is pulled in the backward direction, the force of pulling the first slope part 222 upward increases. Hence, the force of the front part of the plate spring 200 for entering the back side of the band 4 is generated, and thus the binding force of the band by the plate spring 200 increases and the fastened state of the band 4 is firmly maintained.

Figure 6B:
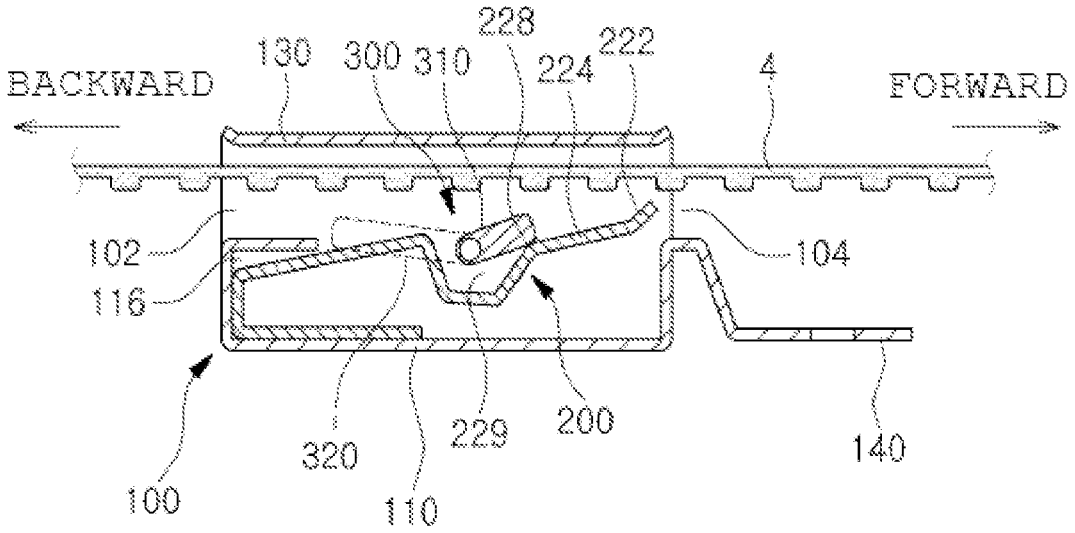

Further, when intending to loose the band 4, as illustrated in FIG. 6B, the operation lever 310 of the buckle switch 300 is rotated to the front surface part 130 of the buckle body 100.

As such, the pivot pressure piece 310 of the buckle switch 300 pressures the plate spring 200, and thereby the front part of the plate spring 300, i.e., the first slope part 222 is separated from the band 4. Hence, the band 4 is slid in a reverse direction.

At this time, as described above, the pivot pressure piece 310 is rotated so as to pressure the projection 228 of the plate spring 200, and thus strong force is applied to the plate spring 200 even if the user slightly rotates the operation lever 320 with little force.

Likewise, the user can compress the plate spring 200 with little force, and thus even if the plate spring 200 with a relatively high intensity is used to enhance the fastening force of the buckle, the user would not feel inconvenient.

Hereinafter, another embodiment according to the present invention will be described, and the description on the points which have already been described with reference to the first embodiment of the present invention is omitted here.

Figure 7:
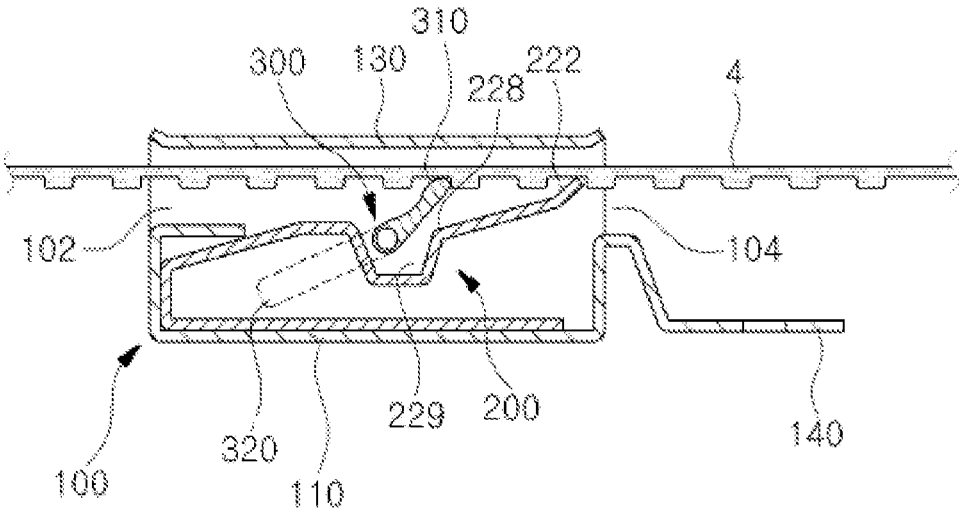
FIG. 7 illustrates a second embodiment of the present invention.

FIG. 7 shows a second embodiment according to the present invention. FIG. 7 shows that the pivot pressure piece 310 along with the plate spring 200 functions as a stopper which controls the slide of the band 4.

As illustrated, the pivot pressure piece 310 is elastically supported by the plate spring 200 so that the front part is positioned on the sliding path of the band 4. Hence, when the band 4 is pulled in the backward direction, the catch projection 2 of the band 4 is caught on the front part of the pivot pressure piece 310 so as to control the slide of the band 4.

Likewise, both the plate spring 200 and the pivot pressure piece 310 functions as a stopper which controls the slide of the band 4, the fastened state of the band 4 is more firmly kept. Further, when the band 4 is pulled in the backward direction, the force applied to the band 4 is distributed to two pars which are the part where the plate spring 200 contacts the band 4 and the part where the pivot pressure piece 310 contacts the band, and thus the band 4 is less damaged.

In the present embodiment, the base part 210 of the plate spring 200 is extended long. Likewise, the base part 210 of the plate spring 200 is extended relatively long, even if the plate spring 200 is not accurately inserted into the plate spring mounting groove 116, the plate spring 200 is stably placed in the buckle body 200.

FIG. 8 shows that the plate spring is integrally formed with the buckle body 100 according to a third embodiment of the present invention.

Figure 8A:
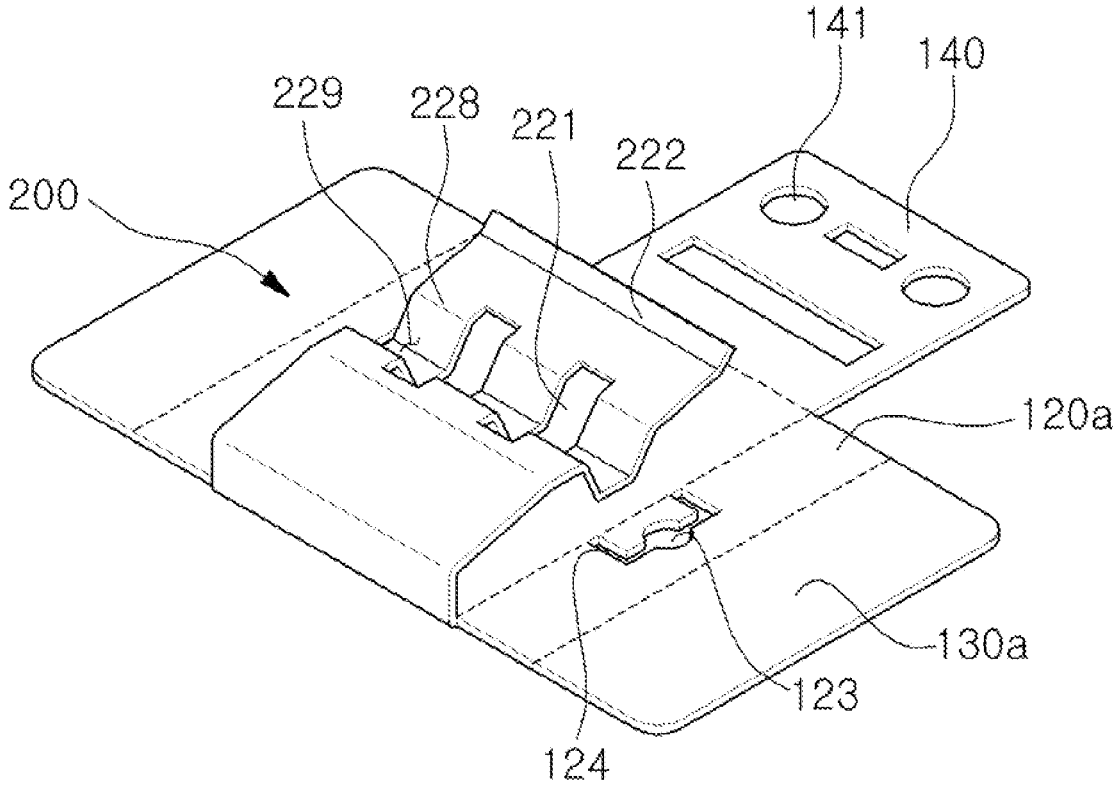
FIGS. 8A and 8B are a perspective view and a cross-sectional view according to a third embodiment of the present invention.
Figure 8B:
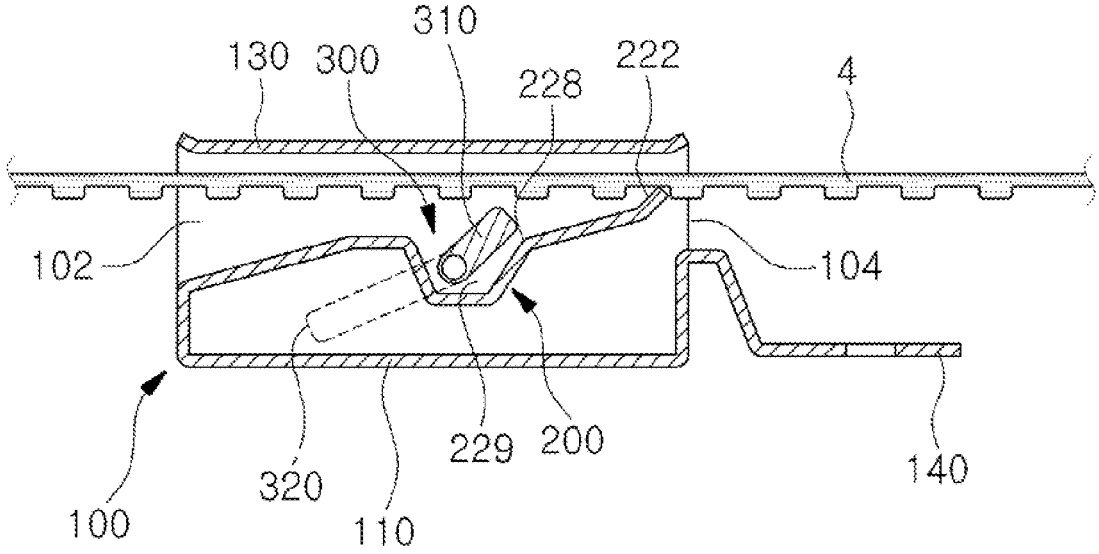

Referring to FIGS. 8A and 8B, the portion for forming the plate spring 200 is extended at the left side of the back side forming unit 110*a*, and the extended portion for forming the plate spring 200 is bent to the upper side of the back side forming unit 110*a* so as to form the plate spring 200.

Before ending the extended portion for forming the plate spring 200 to the upper side of the back side forming unit 110*a*, the above-described groove 221 is formed, and a first slope part 222, a second slope part 224, a third slope part 226, and a concave part 229 are also formed.

Likewise, if the plate spring 200 is integrally formed with the buckle body 100, the process of inserting the plate spring 200 into the buckle body 100 is omitted, thereby reducing the manufacturing process.

FIG. 9 shows that the plate spring 200 is formed by cutting the back side part 110 of the buckle body 100 according to a fourth embodiment of the present invention.

Figure 9A:
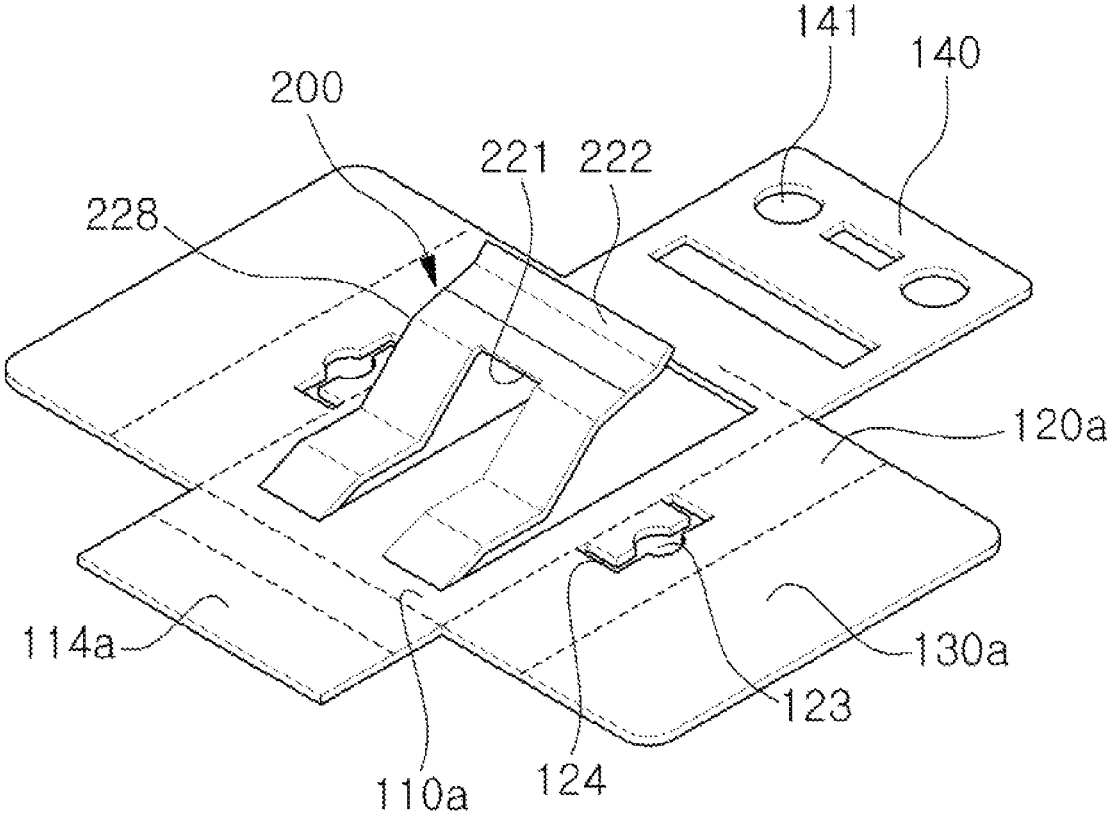
FIGS. 9A and 9B are a perspective view and a cross-sectional view according to a fourth embodiment of the present invention.
Figure 9B:
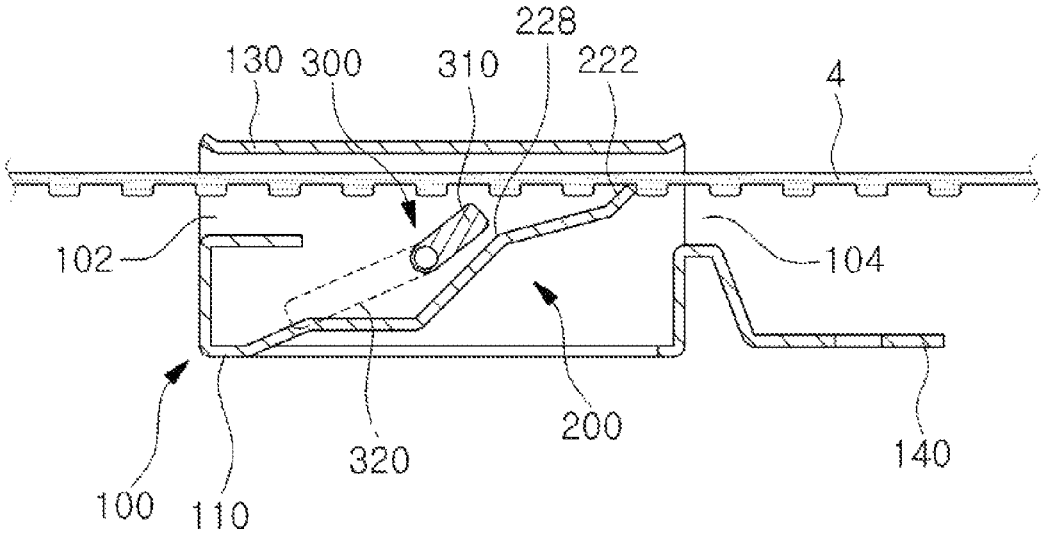

Referring to FIGS. 9A and 9B, part of the back side part 110 of the buckle body 100 is cut to form the plate spring 200. Further, the cut portion is formed as the first, second, and third slope parts 222, 224, and 226 and concave part 229, and then it is bent into the buckle body 100, thereby forming the plate spring 200.

According to the present embodiment, as the process of inserting the plate spring 200 into the buckle body 100 is omitted, the manufacturing process is reduced, and the material costs are reduced compared to the above third embodiment.

Likewise, when the plate spring 200 is integrally formed with the buckle body 100, the buckle body 100 is formed by using the progressive molding.

Figure 10A:
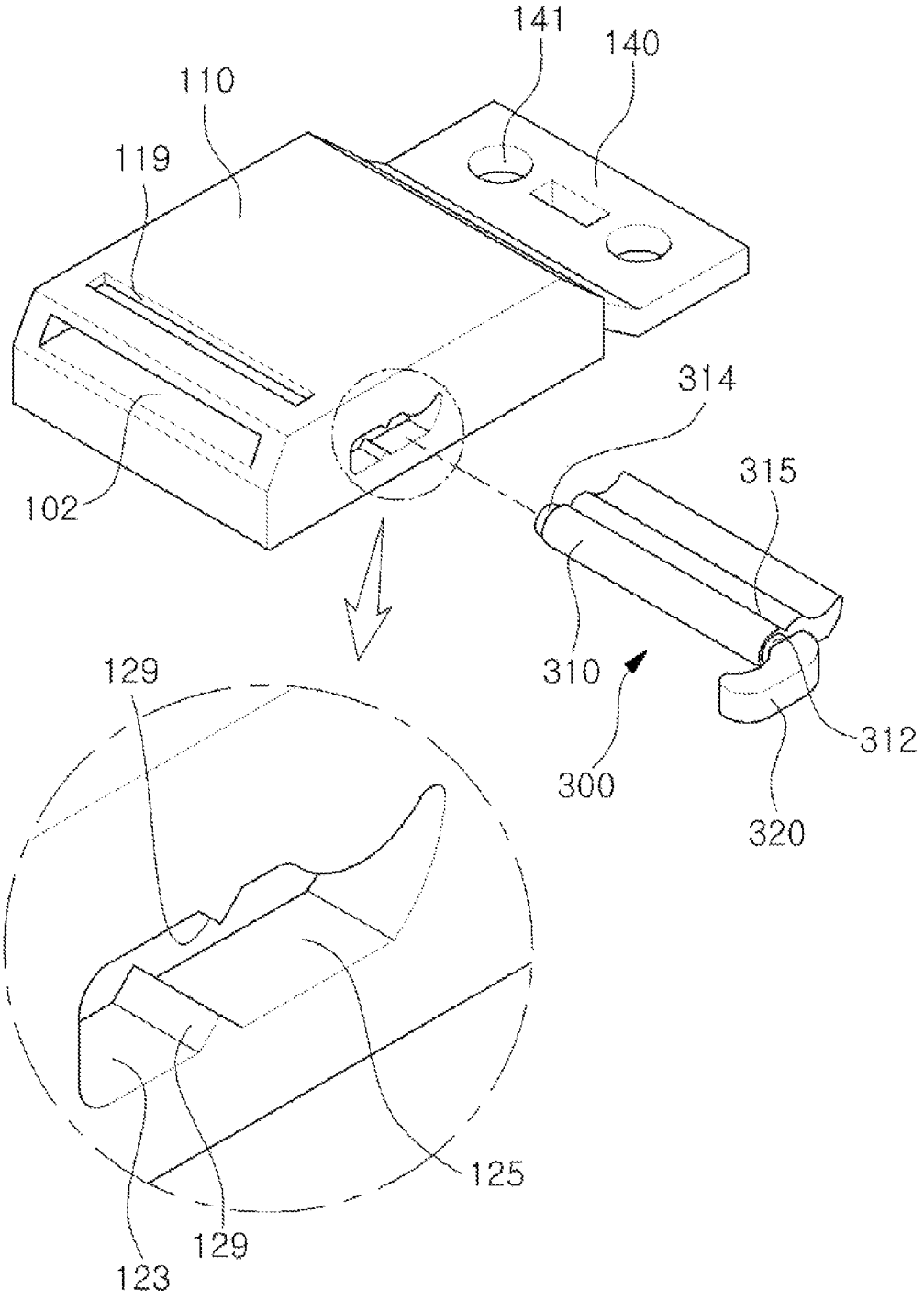
FIGS. 10A and 10B are a perspective view and a side cross-sectional view according to a fifth embodiment of the present invention.

FIGS. 10A and 1B show that the buckle body 100 is injection-molded by synthetic resins according to a fifth embodiment of the present invention.

Figure 10B:
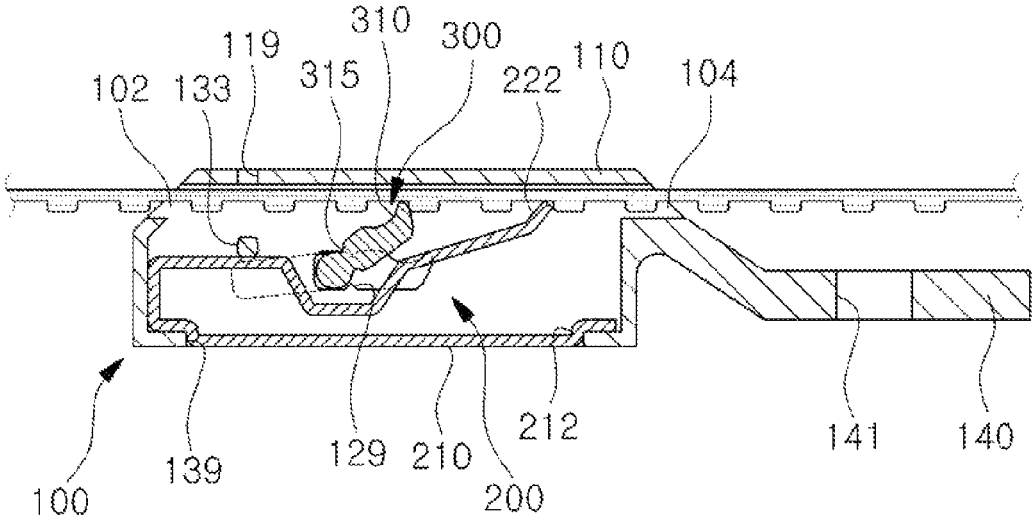

Referring to FIGS. 10A and 10B, the buckle body 100 is injection-molded with synthetic resins to have a box shape having the back side part 110, the front surface part 130, the upper and lower surface parts 120 and 121, and the insertion hole 102 and the exit hole 103 are formed at the right and left sides of the buckle body 100.

In this case, the plate spring 200 is placed inside the buckle body 100 through the exit hole 104 of the buckle body 100. Reference numeral 133 is a support bar which is formed to cross the buckle body 100 in order to support and fix the plate spring 200 at the inside of the buckle body 100.

Preferably, as illustrated, holes 119 and 139 for making the manufacturing of an injection mold easy are formed at the back side part 110 and the upper surface part 130 of the buckle body 100. Further, a bent part 212, which is inserted into the hole 139 formed on the back side part 110, is formed on the base part 201 of the plate spring 200.

Hence, as the bent part 212 of the plate spring 200 is inserted into the hole 139, the plate spring 200 is stably mounted in the buckle body 100, and the thickness of the buckle body 100 may be reduced.

Further, a hinge hole 123 for hinge-jointing the buckle switch 300 is formed in the upper and lower surface parts 120 and 121 of the buckle body 100, and an opening 125 for inserting the pivot pressure piece 310 into the buckle body 100 is extended in the hinge hole 123 in the direction of the exit hole 102. The opening 125 is formed in the same shape as that of the side cross-section of the pivot pressure piece 310.

Further, a pair of V-shaped projections 129 are formed facing each other between the hinge hole 123 and the opening in order to prevent the hinge projections 312 and 314 of the pivot pressure piece, which has been inserted into the hinge hole 123, from being moved to the opening 125.

Further, a notch 315 of a shape corresponding to the V-shaped projections 129 is formed in the end part of the pivot pressure piece 310.

Hence, when assembling the buckle switch 300 in the buckle body 100, as illustrated in FIG. 10A, the notch 315 is arranged in the V-shaped projections 129 and the pivot pressure piece 310 is arranged in the opening 125 so that the pivot pressure piece 310 may be inserted into the buckle body 100.

The pivot pressure piece 310, which has been inserted into the buckle body 100, is rotated by the plate spring 200 so as to be placed slant, and thus the pivot pressure piece 310 is separated from the opening 125.

The opening 125 has the same shape as that of the side cross-section of the pivot pressure piece 310, and thus even if the pivot pressure piece 310 is a little rotated, the pivot pressure piece is prevented from being loosed from the opening.

Likewise, the assembly buckle switch 300 is not moved from the hinge hole 123 to the opening 125 as the hinge projections 312 and 314 are caught on the V-shaped projections 129, and thus the button switch 300 is smoothly rotated.

The opening 125 is formed at both hinge holes 123, and thus the buckle switch 300 may be selectively assembled at both sides of the buckle body 100 depending on the work environment.

In some cases, a separate cover, which is inserted into the opening 125, may be prepared instead of the V-shaped projections 129 and the notch 315, and thus hinge projections 312 and 314 may be prevented from being moved to the opening 125 by closing the opening 125 by the cover.

Figure 11:
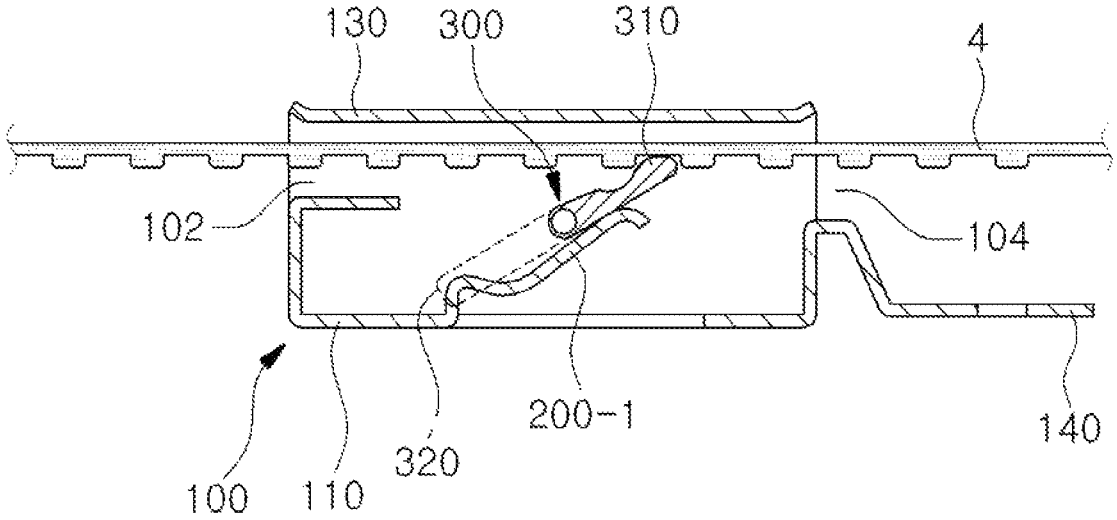
FIG. 11 is a cross-sectional view according to a sixth embodiment of the present invention.

FIG. 11 shows that the pivot pressure piece 310 of the button switch 300 functions as a stopper according to a sixth embodiment of the present invention.

As illustrated, the buckle body 100 is formed by bending the metal plate, and the plate spring 200-1 cuts the back side part of the buckle body 100 and bends the back side part 110 into the buckle body 100 so as to be formed. Further, the pivot pressure piece 310 is positioned slant in a direction that gets close to the band 4 toward the leading part, and the leading part is elastically supported by the plate spring 200-1 so as to be positioned on the sliding path of the band 4.

Hence, if the band 4 is pulled in the forward direction, the plate spring 200-1 is compressed by the force applied to the band 4 and the catch projections 2 of the band 4 go over the leading part of the pivot pressure piece 310 so that the band slides in the forward direction.

Further, in a reverse manner, if the band 4 is pulled or pushed in the backward direction, the leading part of the pivot pressure piece 310 is caught on the catch projection 2 of the band by the elastic force of the plate spring 200-1, thereby controlling the slide of the band 4.

The invention claimed is:

1. A buckle for tightening or loosening a band with a back side having at least one catch projections formed widthwise, the buckle comprising:

a buckle body having an insertion hole and an exit hole for slidingly passing the band, and a pair of hinge holes formed across a sliding path of the band;

a plate spring arranged in the buckle body with a leading part positioned in the sliding path of the band, the leading part being shaped to slope with a leading end contacting the back side of the band by an elastic force of the plate spring so as to be caught by the at least one catch projections of the band when pulling or pushing the band toward a loosening direction and thus to control a slide of the band; and a buckle switch having a pivot pressure piece with hinge projections at both ends inserted in the pair of hinge holes so as to be hinged to the buckle body and positioned between the band and the plate spring, and an operation lever connected to the pivot pressure piece so as to be exposed to one side of the buckle body and configured to be rotated by a user, wherein the pivot pressure piece is configured to rotate and press the plate spring against the elastic force of the plate spring by a rotation of the operation lever, wherein, when the plate spring is pressed by the pivot pressure piece, the leading end of the plate spring is separated from the band so as to make the band slide in the loosening direction, and wherein, when the plate spring is not pressed by the pivot pressure piece, the leading end of the plate spring catches the at least one catch projections of the band by the elastic force of the plate spring.

2. The buckle of claim 1, wherein the pivot pressure piece is tilted in the same direction as a tilted direction of the plate spring, the leading part is positioned on the sliding path of the band, and thus if the band is pulled or pushed in the loosening direction, the leading part of the pivot pressure piece along with the leading part of the plate spring are caught on the at least one catch projections of the band so that the slide of the band is controlled.

3. The buckle of claim 1, wherein the plate spring is mounted on the buckle body as a separate part or is integrally formed with the buckle body.

4. The buckle of claim 1, wherein the plate spring is formed by folding a part of the buckle body.

5. The buckle of claim 1, wherein the leading part of the plate spring comprises:

a first slope part which is caught on the at least one catch projections as the first slope part gets tilted toward a distal end of the first slope part to be close to the band;

a second slope part which is extended from the distal end of the first slope part and have a gradient lower than a gradient of the first slope part; and a third slope part which is extended from a distal end of the second slope part to have a gradient larger than the gradient of the second slope part, wherein a projection is formed between the second slope part and the third slope part and the projection is pressured by a rotation of the pivot pressure piece.

6. The buckle of claim 5, wherein, in the plate spring, a concave part, which is concave in a direction opposite to a tilted direction of the leading part of the plate spring, is formed at a distal end of the third slope part, and wherein the pivot pressure piece is hinge-jointed to the buckle body to be positioned at the concave part.

7. The buckle of claim 1, wherein the buckle body is formed by bending a metal plate, wherein an opening is formed on the buckle body by a cut piece which is cut in a form that divides each hinge hole, and wherein, if the pivot pressure piece is inserted into the buckle body through the opening and then the opening is closed with the cut piece, the pivot pressure piece is hinge-jointed to the each hinge hole.

8. The buckle of claim 1, wherein the buckle body is injection-molded, wherein an opening for inserting the pivot pressure piece into the buckle body is extended, and a pair of V-shaped projections facing each other are formed between each hinge hole and the opening, wherein a notch corresponding to the V-shaped projections is formed at the end of the pivot pressure piece, wherein, if the pivot pressure piece is inserted into the buckle body by arranging the V-shaped projections and the notch, the pivot pressure piece is elastically supported by the plate spring and is rotated with a slope, and wherein hinge projections are moved from the each hinge hole to the opening by the V-shaped projections.

* * * * *